US006062303A

United States Patent [19]

Ahn et al.

[11] Patent Number: 6,062,303

[45] Date of Patent: May 16, 2000

[54] MULTIFLOW TYPE CONDENSER FOR AN AIR CONDITIONER

[75] Inventors: Yong Gwi Ahn; Sang Yul Lee; Seung Hwan Kim; Sang Ok Lee; Kwang Heon Oh; Yong Ho Kim, all of Taejon, Rep. of Korea

[73] Assignee: Halla Climate Control Corp., Taejon, Rep. of Korea

[21] Appl. No.: 09/161,093

[22] Filed: Sep. 25, 1998

[30] Foreign Application Priority Data

Sep. 26, 1997 [KR] Rep. of Korea ..... 97-49276
Sep. 19, 1998 [KR] Rep. of Korea ..... 98-38816

[51] Int. Cl.[7] ..... F28B 1/06

[52] U.S. Cl. ..... 165/110; 165/174

[58] Field of Search ..... 165/110, 173, 165/174, 153

[56] References Cited

U.S. PATENT DOCUMENTS

| | | | |
|---|---|---|---|
| 1,991,631 | 2/1935 | Sangster | 165/174 |
| 4,243,094 | 1/1981 | Woodhull, Jr. et al. | 165/174 X |
| 4,972,683 | 11/1990 | Beatenbough | 165/110 X |
| 4,998,580 | 3/1991 | Guntly et al. | 165/173 X |
| 5,236,044 | 8/1993 | Nagasaka et al. | 165/173 X |
| 5,372,188 | 12/1994 | Dudley et al. | 165/110 |

FOREIGN PATENT DOCUMENTS

| | | | |
|---|---|---|---|
| 63-173688 | 11/1988 | Japan . | |
| 3-140764 | 6/1991 | Japan . | |
| 3-211375 | 9/1991 | Japan . | |
| 3-247993 | 11/1991 | Japan | 165/174 |

*Primary Examiner*—Leonard R Leo
*Attorney, Agent, or Firm*—Ladas & Parry

[57] ABSTRACT

A multiflow type condenser for an automobile air conditioner comprising: a pair of header pipes disposed in parallel with each other and arranged to have an inlet and an outlet; a pluratlity of flat tubes each connected to said header pipes at opposite ends thereof, each of said flat tubes having a plurality of inside fluid paths, a hydraulic diameter of said inside fluid paths being in the range of about 1 to 1.7 mm; a plurality of corrugated fins each disposed between adjacent flat tubes; at least a pair of baffles disposed in said header pipes one by one; each of said baffles having a projection inserted into a slit provided with each header pipes and dividing each header pipes into a plurality of chambers; at least one by-pass passageway formed in the baffles to route a vapor-abundant phase of said refrigerant from an upper chamber to a lower chamber within the same header pipes by providing a communication path between the adjacent chambers; a ratio of a hydraulic diameter of said by-pass passageway over said hydraulic diameter of said inside fluid paths being in the range of about 0.28 to 2.25; and an area of a pass on the inlet side is about 30% to 65% of an overall area of all of said passes.

12 Claims, 10 Drawing Sheets

MULTIFLOW TYPE CONDENSER FOR AN AIR CONDITIONER

FIELD OF THE INVENTION

This invention relates to a multiflow type condenser for use in an air conditioning system, and more particularly to a condenser for automobiles in which high efficiency of heat transfer is achieved by permitting a liquid refrigerant changed in phase during condensing process to be by-passed between chambers formed in the headers of the condenser.

BACKGROUND OF THE INVENTION

Recent trends in condensers for automobiles, which receive a gaseous refrigerant, condense the refrigerant through heat exchange with air, and then discharge to an evaporator via an expansion means, have produced compact designs with high performance heat exchange characteristics, in accordance with the demand of small size and lightweight construction desired for car-related parts. A typical parallel flow type condenser includes a plurality of flat tubes with a plurality of corrugated fin, each corrugated fin being intervened between adjacent flat tubes, and a pair of headers to which each flat tube is connected at both ends thereof.

For aid in understanding, the reader is referred to FIG. 13. A parallel flow type condenser 60 includes first and second headers 61 and 62, a plurality of flat tubes 63, and a plurality of corrugated fins 64 disposed between adjacent flat tubes 63. Both ends of each flat tube are connected between the first and second headers 61 and 62, and at least one baffle 65 is provided within each header 61, 62 so that the refrigerant in the condenser makes multiple passes with each defined by flat tubes 63. Thus, refrigerant flows through the condenser in a zigzag pattern. The condenser with the above construction is smaller in size, more lightweight, and yet of high efficiency in heat transfer than a conventional serpentine type condenser. Therefore, the parallel flow type condenser is widely employed in automobile air conditioning systems.

In general, the refrigerant is introduced into a condenser in a vapor phase, and as the refrigerant flows from an inlet toward an outlet the refrigerant is completely changed into a liquid phase in the area on the outlet side after experiencing a gas/liquid two-phase state. Accordingly, the refrigerant exits the condenser in liquid phase to an external element of a refrigerant circuit. Namely, a vapor-abundant phase of the refrigerant flows through an upper area of the condenser shown in FIG. 13, while a liquid-abundant phase condensed from the vapor phase gradually increases approaching an lower area of the condenser, and therefore, it appears that the two-phase refrigerant flows through the condenser as a whole. During the phase change of the refrigerant, a thin liquid film, which is formed on the inside wall of each flat tube positioned in the area through which the vapor-adundant phase flows, acts as a thermal resistance hindering heat transfer between the refrigerant and the air. Furthermore, due to the rapid flow rate of the vapor phase as compared to the liquid phase, the liquid film acts as a flow resistance to the flow of the refrigerant through the condenser so that a pressure drop, i.e. pressure loss, takes place between the inlet and the outlet, which necessarily increases system energy requirements.

Commonly, it is important in designing a condenser to provide an increased heat transfer area and yet a lower pressure drop on the refrigerant side in order to enhance the performance of the condenser. Methods of increasing the heat transfer area of the flat tubes include two alternatives:

one is to decrease the hydraulic diameter of each inside flow path which are formed within each flat tube to allow the refrigerant to be passed therethrough, while the other is to increase the number of passes so as to make the length of the overall fluid paths for the refrigerant passage longer, each pass including a plurality of flat tubes.

As for decreasing the hydraulic diameter of inside flow paths, U.S. Pat. No. 4,998,580 discloses a tube having a plurality of fluid flow paths formed-by a undulating spacer within the tube. Each of the fluid flow paths has a very small hydraulic diameter. However, the hydraulic diameters of the fluid flow paths are so small that a higher pressure drop developer in each pass due to the corresponding increse of refrigerant passage resistance. In a condenser to which the tubes each having such a small size of fluid flow paths are utilized, the overall length of fluid paths for the refrigerant passage must be shorter than a condenser with relatively large hydraulic diameter tubes or more passes, in order to account for the higher pressure drop in each pass. Accordingly, in U.S. Pat. No. 4,998,580, if the number of the refrigerant passes increases, for example, over three, too much pressure drop on the refrigerant side occurs and results in an increase in of system energy requirements.

As for the method of increasing the overall fluid paths for the refrigerant passage, as shown in FIG. 13, a plurality of baffles or partitions are provided in the headers, the provision of which causes the refrigerant introduced into the condenser to flow across the condenser in a zigzag fashion, and as a consequence, increasing the effective cross-sectional area of tubes. It seems that this design is more frequently used in automobile air conditioning systems. In this condenser design, considering the phase change of the refrigerant from vapor into liquid occurring during passage of the refrigerant through the condenser, effective heat transfer area or the number of tubes in the uppermost pass on the inlet side is relatively larger and effective heat transfer area of passes are progressively reduced toward the lowermost pass on the outlet side because of large volume and rapid flow rate of the gaseous refrigerant as compared with the liquid refrigerant. Due to these considerations, most heat exchange takes place in the uppermost pass on the inlet side and, in addition, the flow resistance of refrigerant across the condenser is reduced as well.

However, when tubes having an excessively small hydraulic diameter tubes or overly long fluid paths are selected to enhance the heat transfer efficiency of condensers, the heat transfer effiency does increase but the load exerted on a compressor rises according to the increase of pressure drop due to large flow resistance of the refrigerant between the inlet and the outlet of the condenser. Accordingly, to prevent an excessive pressure drop from taking place and to obtain the desired heat transfer efficiency, it is required that the number of U-turns in flow of the refrigerant be minimized for the condenser tubes with a small size of hydraulic diameters on one hand and the number of U-turns be at least two for the condenser with tubes of relatively large hydraulic diameters on the other hand.

In the meantime, for a condenser in which the length of fluid paths of the refrigerant is established long by allowing the refrigerant to flow in a zigzag fashion because of provision of at least one baffle in the headers, prior art is known that includes by-pass passageway formed at the center of the baffles to make a pressure drop according to increase of the fluid path length to be minimized and to permit a liquid refrigerant condensed passing through passes to be by-passed to an outlet side of the condenser.

For example, U.S. Pat. No. 4,243,094 (the "'094" Patent) discloses a condenser including a pair of headers, a plurality of tubes (conduit members) with fins surrounding each of the tubes, and baffles having a bore. Bores are of a size which allow the condensed liquid through each pass to flow therethrough by capillary action into a adjacent lower chamber in the same header without passing through a subsequent pass. The '094 Patent describes that centrally disposed bores are so small that they act as capillary tubes and effectively prevent gaseous fluid from passing therethrough. Therefore, the bores insure that only fluid in a liquid state will pass therethrough.

However, since the '094 Patent does not mention expressly the number of passes for the refrigerant passage, the sizes of the hydraulic diameters of tubes and the bores (by-pass passageways), and the relation therebetween, it is difficult to apply the '094 Patent to the actual design of a condenser. For example, what heat transfer efficiency would be obtained based on the number of passes selected for the refrigerant passage? How are the sizes of by-pass passageways defined? And how should the by-pass passageways be established in view of the number of passes for the refrigerant passage and the hydraulic diameter of tubes? Furthermore, it is difficult to form bores in the baffles and to dispose the baffles within the headers, considering that the bores should have a small diameter and a long length to accomplish capillary action in fluid flow.

Another prior art document concerning the by-pass of the condensed liquid refrigerant is Japanese Unexamined Utility Model No. 63-173688 (application No. 62-064734) which discloses, as shown in FIGS. 14 and 15*a* and 15*b*, a condenser including a pair of headers 70 having tubes 78 each connected to the headers at both ends thereof, and a baffle means 73 having an upper member 74, a meshed member 77 and a lower member 75. The baffle means 73 divides an internal space of each header 70 into upper and lower chambers 71 and 72, respectively. Each upper and lower member 74 and 75 is provided with a hole 76, and liquid refrigerant is by-passed from the upper chamber 71 into the lower chamber 72 through the holes 76 and the meshed member 77. However, the condenser with the above construction does not disclose the relation between the heat transfer efficiency and the pressure drop, the number of passes for the refrigerant passage, the size of by-pass passageways, and the relation therebetween, except simple description about by-passing the liquid refrigerant through the by-pass passageways formed in the baffle means.

SUMMARY OF THE INVENTION

The present invention is directed to overcoming one or more of the above problems, has its object to provide a multiflow type condenser wherein the condenser enhances heat transfer efficiency and minimizes pressure drop on the refrigerant side as well, by differentiating an effective area of each pass for an refrigerant passage in consideration of a phase of the refrigerant flowing through the passes.

Another object of the present invention is to provide a condenser which effectively by-passes a liquid refrigerant by optimizing a size of by-pass passageways according to a hydraulic diameter of tube.

Still another object of the present invention is to provide a condenser with a by-pass passageway to be easily formed.

According to the present invention, there is provided a multiflow type condenser for an automobile air conditione comprising:

a pair of header pipes disposed in parallel with each other and arranged to have an inlet and an outlet, said header pipes being elliptical in cross-section;

a plurality of flat tubes each connected to said header pipes at opposite ends thereof, each of said flat tubes having a plurality of inside fluid paths, a hydraulic diameter of said inside fluid paths being in the range of about 1 to 1.7 mm;

a plurality of corrugated fins each disposed between adjacent flat tubes;

at least a pair of baffle disposed in said header pipes;

at least one by-pass passageway formed around a position at which the chambers in each header pipe are divided by the baffle therein to route a vapor-abundant phase of said refrigerant from an upper chamber to a lower within the same header pipes by providing a communication path between the adjacent chambers;

a ratio of a hydraulic diameter of said by-pass passageway to said hydraulic diameter of said inside fluid paths being in the range of about 0.285 to 2.25; and an area of a pass on the inlet side defined by the chamber on the inlet side into which said refrigerant is introduced through said inlet and formed in one of said header pipes, the opposed chamber formed the other Os said header pipes, and a plurality of tubes extending between the chambers is 30% to 65% of an overall area of all of said passes.

DESCRIPTION OF THE PREFERRED EMBODIMENTS

Figure 1:
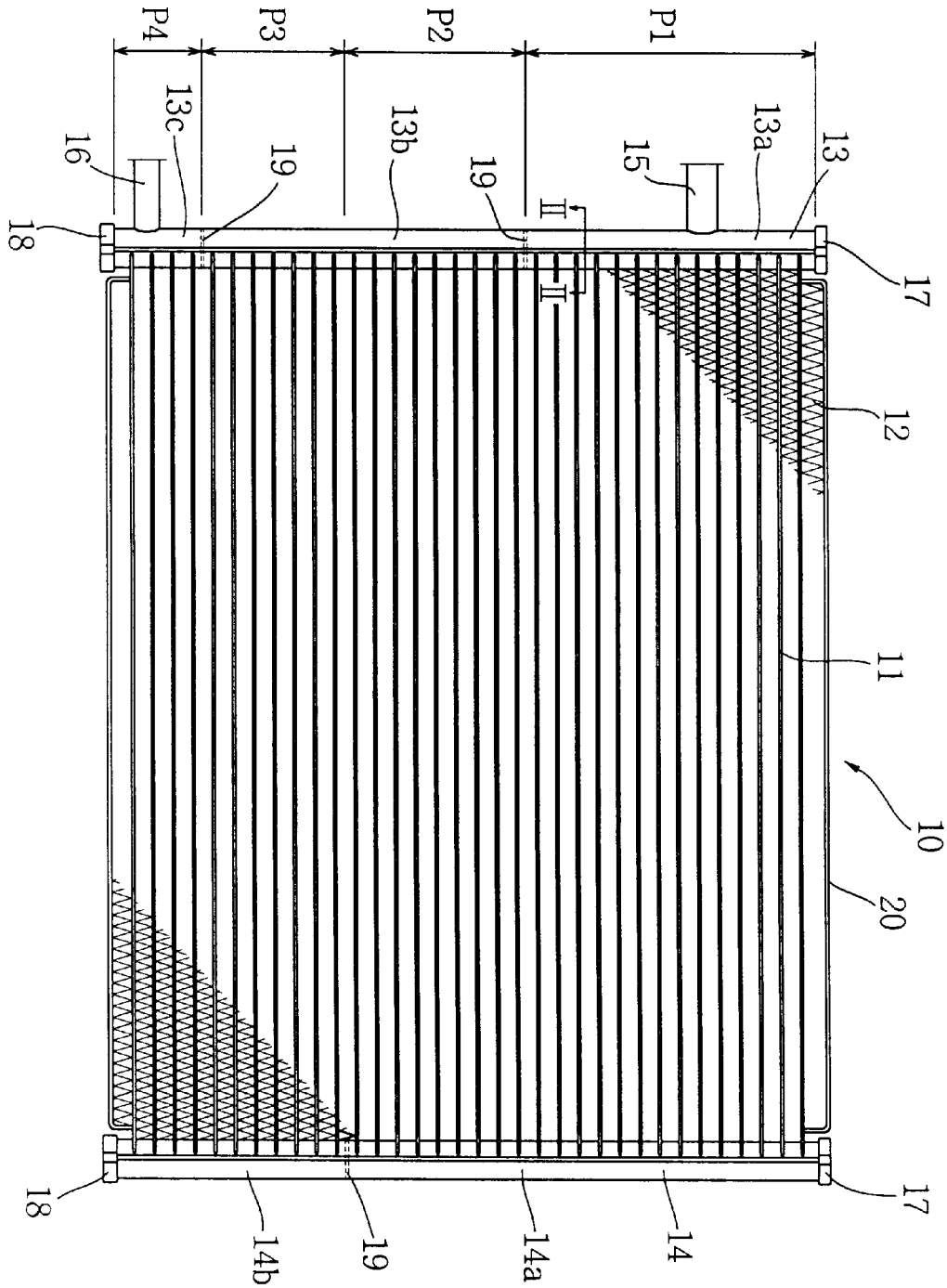
FIG. 1 is a front view of a condenser according to the present invention.

Referring now to FIG. 1, there is shown a condenser 10 which comprises a plurality of flat tubes 11 disposed in a parallel relationship, and a plurality of corrugated fins 12, each fin 12 being intervened between adjacent flat tubes 11. Each of the flat tubes 11 is connected to a first header pipe 13 at its one end, and to a second header pipe 14 at the other end thereof. The condenser also has a pair of side plates 20 disposed at the outermost positions thereof. Both ends of each of the header pipes 13 and 14 are closed by blind caps 17 and 18. An inlet pipe 15 is connected to the first header pipe 13 adjacent its upper end and an outlet pipe 16 is also connected to the first header pipe 13 adjacent its lower end. While both inlet and outlet pipes 15 and 16 are shown as connected to the first header pipe 13, the pipes 15 and 16 may be connected to the first and second header pipes 13 and 14, respectively, according to changes in the number of passes for the refrigerant passage.

Both the first and second header pipes 13 and 14 contain therein baffles 19 adapted to define a plurality of passes for the refrigerant passage, each pass being defined by a plurality of flat tubes 11. In this embodiment of FIG. 1, there are defined four passes P1,P2,P3 and P4, and the number of passes is changed according to the number of baffles 19 provided. In the multiflow type condenser with the above construction, the refrigerant flows through the passes in a zigzag fashion, until the refrigerant is drawn off through the outlet pipe 16 after introduction into the condenser 10. In an examplary embodiment of the condenser of FIG. 1, by the baffles, three chambers 13*a,* 13*b* and 13*c* are defined in the first header pipe 13, and two chambers 14*a* and 14*b* are defined in the second header pipe 14.

Figure 2:
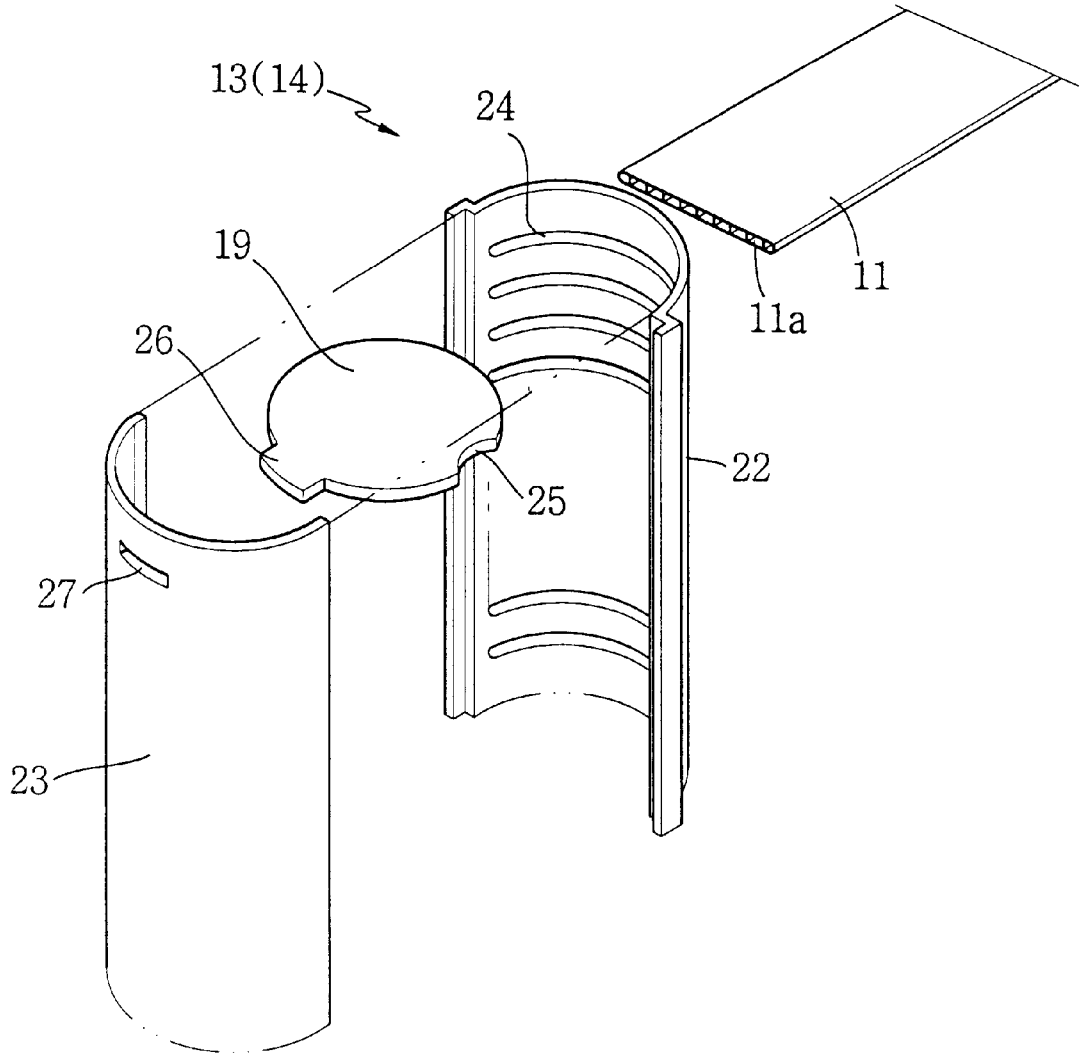
FIG. 2 is a partially exploded perspective view showing the joining relation between header pipes and baffles, and between header pipes and tubes.
Figure 3:
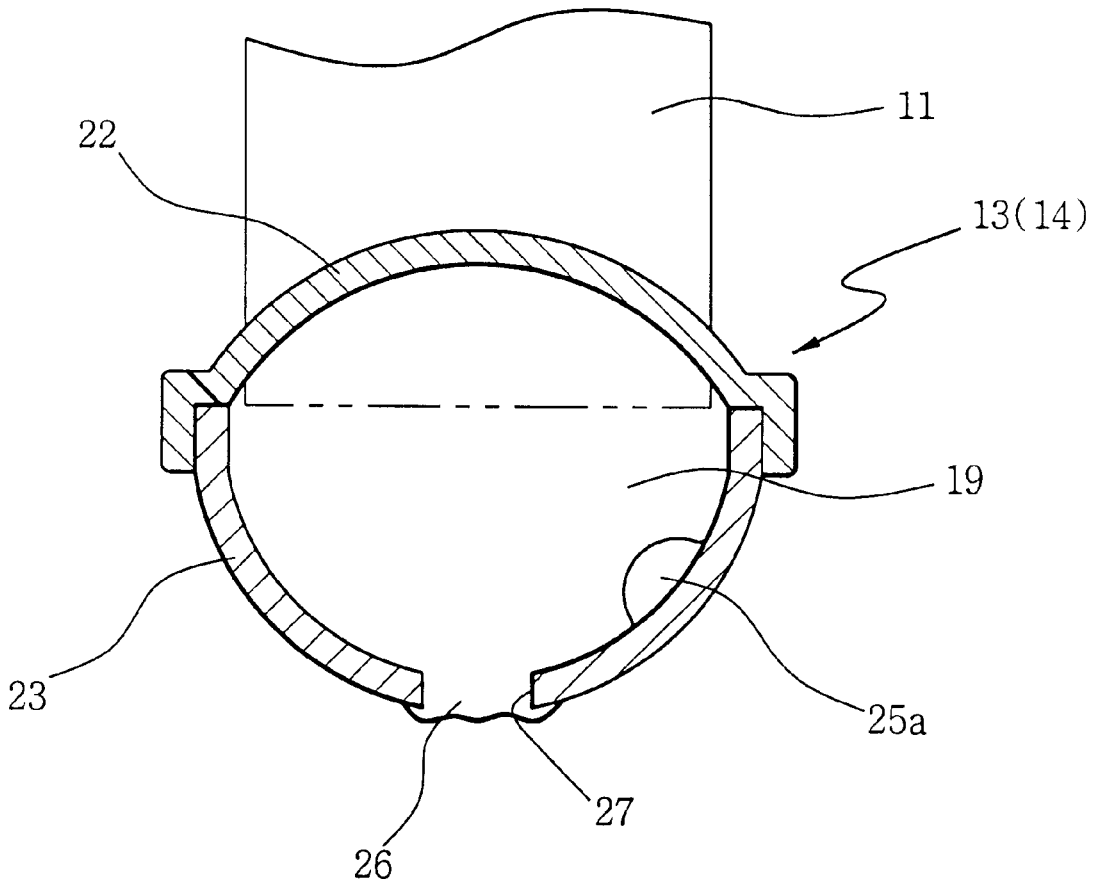
FIG. 3 is a sectional view taken along a line II—II according to one embodiment of the present invention.

Turning now to FIGS. 2 and 3, as shown therein, each flat tube 11 includes a plurality of inside fluid paths 11*a* each defined by an inside wall. Each of the header pipes 13 and 14 is made of a header 22 and a tank 23, and both components form together an elliptical cross-section. Preferably, the shape of cross-section of each tank 23 is semi-circular so as to reduce flow resistance of the refrigerant in the header pipes. Otherwise, the header pipes 13 and 14 may have a circular cross-section and need not consist of two components. The header pipes 13 and 14 with a circular cross-section can be manufactured by seaming or by extrusion using such as a clad aluminium plate.

Headers 22 are provided with a plurality of slots 24 through which flat tubes 11 are inserted and brazed. Baffles 19 are positioned within the header pipes 13 and 14, and the outer circumferences of the baffles 19 follows the inner circumferences of the header pipes 13 and 14 so that the outer circumferential surfaces of the baffles 19 contact the inner circumferential surfaces of the header pipes 13 and 14 when the header pipes 13 and 14 and the baffles 19 are joined together. Otherwise, grooves(not shown) are formed on the inner surfaces of header pipes 13, 14 at which the baffles 19 are positioned, and the size of each baffle 19 defined such that the outer circumferential surface of baffle is fitted into the respective grooves. Each baffle 19 is provided with a projection 26 outwardly extended therefrom, and the projection 26 is inserted into a slit 27 formed in the tank 23 of each header pipe 13,14. When the baffle 19 is fitted into the slit 27, the projection 26 extends outside each header pipe 13,14 to allow the outwardly extended portion of the projection 26 to be pressed on the external surface of each header pipe 13,14 and to cover the slit 27 by caulking or other methods. By doing this, it is possible to prevent the baffles 19 from being displaced during movement of the condenser for brazing and no leakage of refrigerant is likely to occur.

Each baffle 19 is provided with at least one by-pass means. One embodiment of a by-pass passageway according to the invention is shown in FIG. 3. Referring to FIG. 3 together with FIG. 2, at least one cut-out portion 25 is formed in the outer peripheral portion of the baffle 19 by press working at the same time as making the baffle 19. A by-pass passageway 25*a* is provided when the baffle 19 is combined with the respective headers 13,14 so that liquid refrigerant changed from the vapor phase is allowed to pass therethrough. Namely, the by-pass passageway 25*a* provides a communication path between adjacent chambers among the chambers 13*a,* 13*b,* 13*c,* 14*a* and 14*b* each defined by the header pipes 13 and 14 and the baffles 19 so as to directly route some of the liquid refrigerant condensed through the passes from chamber to chamber. The by-pass passageway 25*a* may be formed at a central portion of the baffle 19, but preferably, is formed in the outer peripheral portion of the baffle because of the ease of machining same. If the by-pass passageway 25*a,* i.e. cut-out portion 25 is formed at the central portion of the baffle 19, problems arise in that the by-pass passageway should be machined after firstly forming the baffle 19 and the machining tools have a short lifetime when the by-pass passageway formed is smaller than a given size. However, forming of the by-pass passageway 25*a* in the outer peipheral portion of the baffle 19 makes its formation easy because not only formation of the baffle 19 and the cut-out portion 25 can be made in a lump, but also it is advantageous to move the position of by-pass passgeway in view of the refrigerant flow characteristics.

Figure 4:
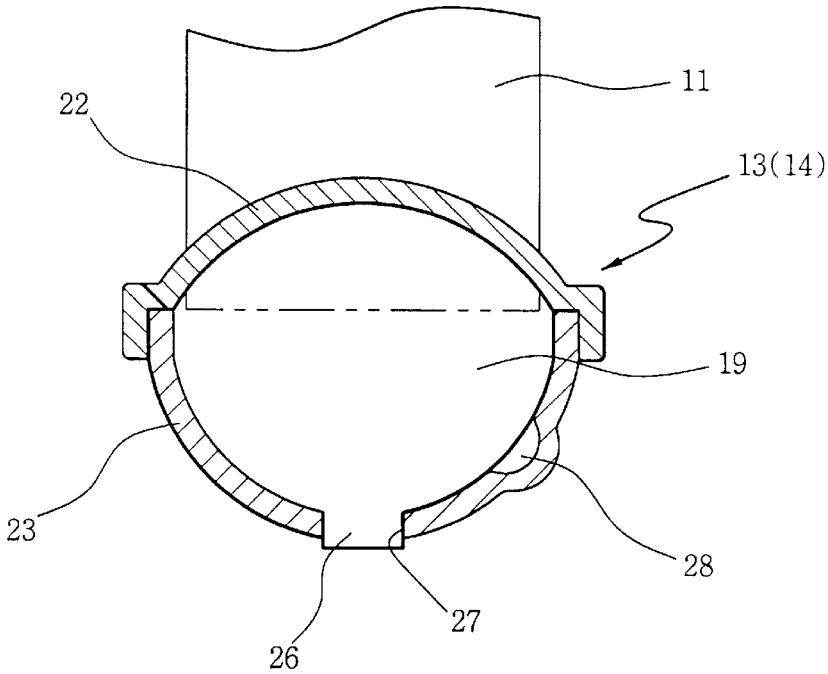
FIG. 4 is a sectional view showing a by-pass passageway according to another embodiment of the present invention.

Turning now to FIG. 4, a further embodiment of the by-pass passageway is shown. In this embodiment, a by-pass passgeway 28 is formed on an inside surface of each header pipe 13,14. The by-pass passageway 28 can be formed along the longitudinal axis of each header pipe 13,14 by extrusion or roll forming, or only at the position at which the baffle 19 is disposed by press working.

Figure 5:
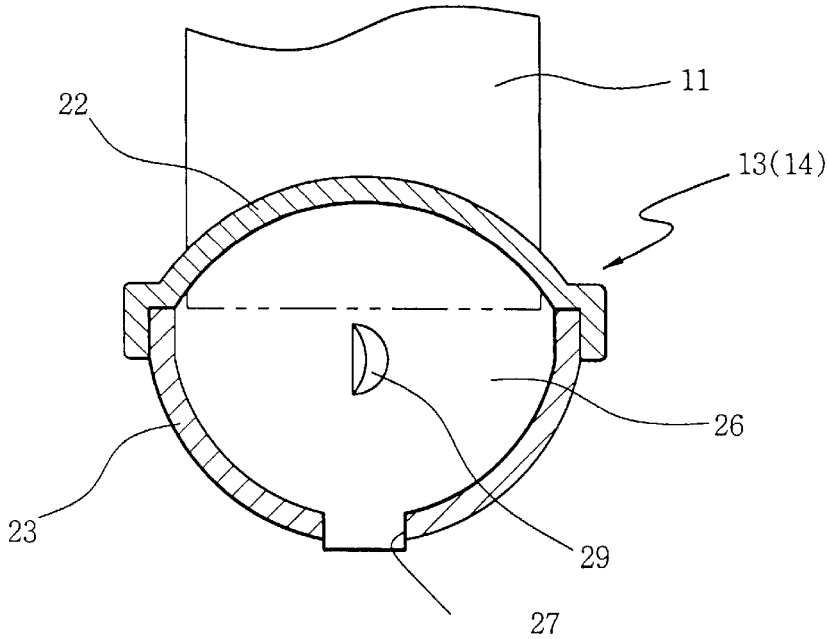
FIG. 5 is a sectional view showing a by-pass passageway according to still another embodiment of the present invention.
Figure 6A:
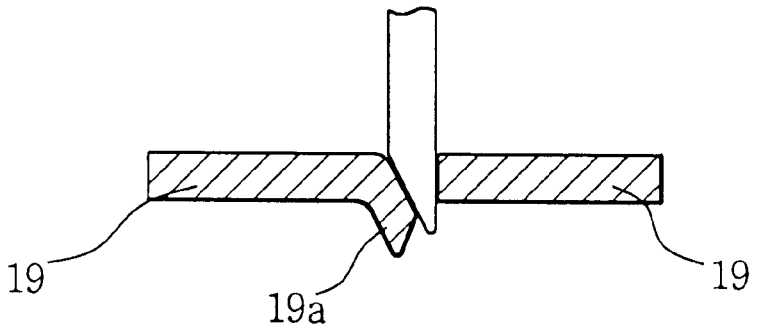
FIGS. 6*a* and 6*b* show examples of forming a by-pass passageway in outline.
Figure 6B:
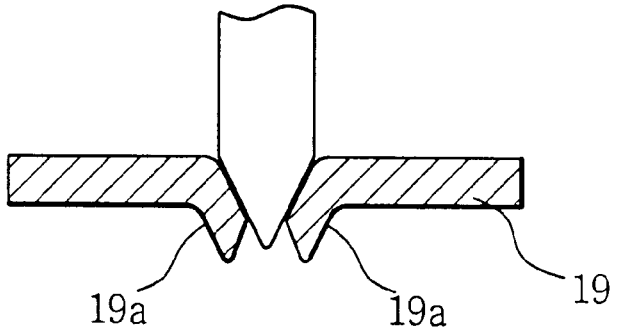

FIG. 5 shows still another embodiment of the by-pass passageway and FIGS. 6*a* and 6*b* show methods of maching the by-pass passageway in outline. As shown, an embodiment is illustrated to supplement defects in machining occurring when the by-pass passageway is formed in a central portion of the baffle 19, and to effectively by-pass the liquid refrigerant. In this embodiment, a by-pass passgeway 29 is made by lancing, burring or scratching. Namely, a portion in which the by-pass passgeway 29 is formed is not cut off from the baffle 19, and the portion has a folded portion 19*a* (FIG. 6*a*) or portions 19*a* (FIG. 6*b*) which guides the liquid refrigerant at the time of by-passing.

Figure 7:
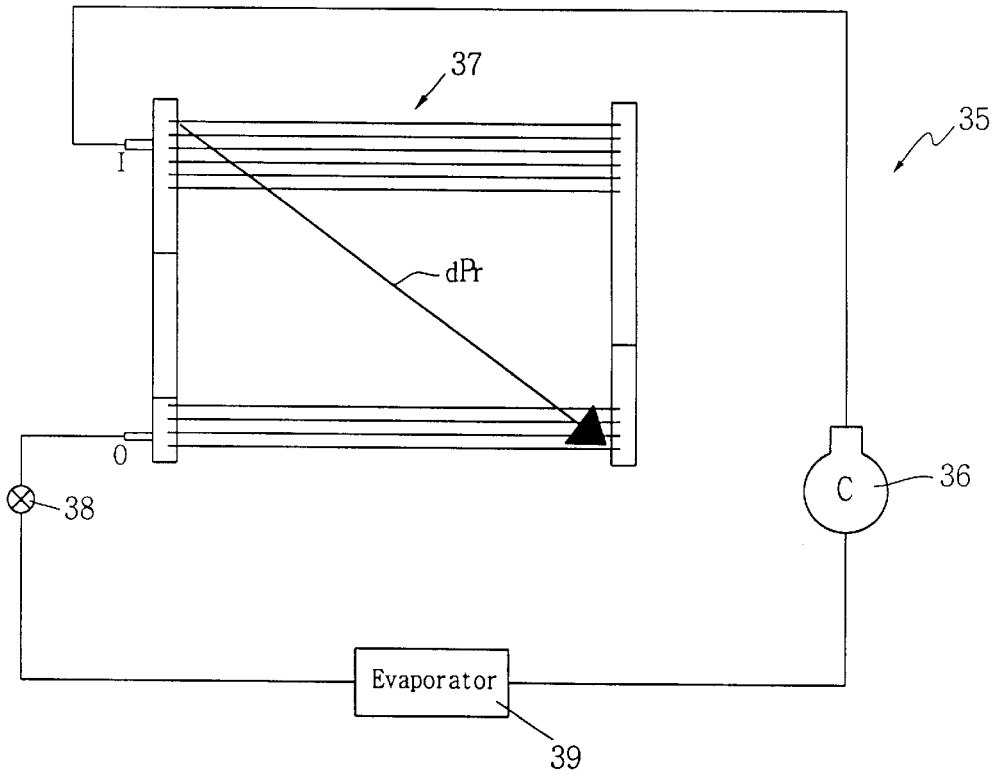
FIG. 7 shows a refrigerant circuit of an automobile air conditioning system.

Referring now to FIG. 7, a refrigerant circuit 35 includes a compressor 36, a condenser 37, an expansion mechanism 38 and an evaporator 39. In the refrigerant circuit 35, the refrigerant is compressed in the compressor 36 to a pressure of about 15–20 kg/cm$^2$ and sent to the condenser 37. The pressure from the compressor 36 is applied to an inlet I of the condenser 37, the refrigerant change from vapor to liquid flowing through the passes of the condenser 37 (4 passes as shown in FIG. 1), and then, exits from the condenser 37 through an outlet O. The pressure and temperature of the liquid refrigerant drop to about 2–5 kg/cm$^2$ passing through the expansion mechanism 38, and the refrigerant is introduced into the evaporator 39 in which heat exchange takes place between the refrigerant and air. Thereafter, the refrigerant travels into the compressor 36 and circulates the refrigerant circuit.

Figure 8:
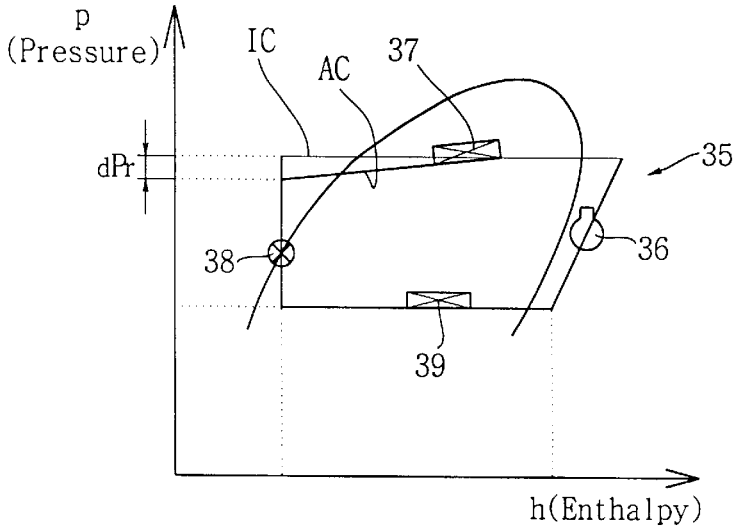
FIG. 8 is a p-h diagram of the refrigerant circuit of FIG. 7.

FIG. 8 is a p-h diagram showing an ideal cycle and an actual cycle of the refrigerant circuit of FIG. 7. As shown in FIG. 8, there occurs no pressure drop dPr on the refrigerant side flowing through the condenser 37 in the ideal refrigerant cycle IC, while in the actual cycle AC, a certain range of pressure drop dPr takes place because the refrigerant is subject to flow resistance at the time the refrigerant travels through the passes of the refrigerant passage. Namely, when measurement is made of an actual refrigerant cycle AC, i.e. between the inlet I and outlet O of the condenser 37, a certain range of pressure drop occurs irrespective of presence of the by-pass passageways. In addition, a pressure drop also occurs on the air side passing through the corrugated fins 12 (FIG. 1). Excessive pressure drops both on the refrigerant and air sides increase the load on compressor, and in turn, the system energy requirements.

As the design of a condenser for use in a car air conditioner changes from the serpentine type to the parallel flow type or the multiflow type, a relatively large single tube used for enhancing the heat transfer efficiency in the serpentine type condenser is replaced by a plurality of flat tubes. Both ends of each flat tube are connected to spaced and parallel headers so as to define a plurality of passes for the refrigerant passage. The refrigerant enters the condenser through the inlet formed in one header and flows in parallel through each flat tube. Accordingly, to accomplish a required performance in the parallel flow type condenser, on one hand, the hydraulic diameter of flat tubes is restricted within a given range which is smaller than the normal hydraulic diameter of flat tubes, on the other hand, the condenser is divided by baffle means so as to define a plurality of passes.

As described above, restriction of the hydraulic diameter of each of flat tubes or inside fluid paths formed in flat tubes below a given value increases the heat transfer efficiency and also the passage resistance of refrigerant passing through each flat tube or inside fluid path. Accordingly, an excessive pressure drop occurs, which, in turn, leads an increase in the system energy required in the overall refrigerant circuit, and as a consequence, one or only a few passes may be utilized. On the other hand, when the hydraulic diameter of flat tubes is in the normal range, i.e. from about 1 mm to about 1.7 mm, the pressure drop decreases because the passage resistance of refrigerant passing through each flat tube or inside fluid path is smaller in comparison with the flat tubes having a hydraulic diameter below 1 mm. Therefore, more passes can be utilized compared with flat tubes with relatively small hydraulic diameters and result in an increase in the length of flow paths and the heat transfer efficiency.

For reference, hydraulic diameter $D_h$ is defined as follows:

$$D_h=4A/P$$

in which A is the cross-sectional area of the tube (each of the inside fluid paths when they are formed within each tube) and P is the wetted perimeter of the corresponding tube, i.e. inside fluid path.

Considering the above mentioned facts, for condensers with a by-pass passageway, it was discovered that the heat transfer and pressure drop relationship was found to be improved as described in further detail below when the designs of condensers restrict the hydraulic diameter of flat tubes within certain prescribed limits for minimizing the pressure drop of refrigerant by reducing the passage resistance of refrigerant flowing through the flat tubes, by-passing the liquid refrigerant from chamber to chamber by providing optimum-sized by-pass passageways with respect to the hydraulic diameters of flat tubes prevent deterioration of the heat transfer performance (by reducing the passage resistance of refrigerant), and optimize the effective areas of passes in view of flow characteristics between the vapor and the liquid.

To design the above condenser, the hydralulic diameter was chosen between 1 and 1.7 mm. If the hydraulic diameter of flat tubes is below 1 mm, excessive prssure drop occurs and thus, the length of fluid paths must be short. If the hydraulic diameter of flat tubes is beyond 1.7 mm, the length of fluid paths must be long to meet the size of the condenser performance and, accordingly, the condenser becomes large. The test was performed for the condenser having the by-pass passageways of the hydraulic diameter of about 1 mm formed in the baffles against conventional condenser without by-pass passageways. In testing, it was found that the condenser with the by-pass passageways has lesser pressure drop and heat transfer efficiency as compared with the condenser without the by-pass passageways. Therefore, another test was performed to ascertain the relationship between the hydraulic diameter of each by-pass passageway and the hydraulic diameter of each flat tube. In the test, the hydralulic diameter of each flat tube (each inside fluid path when formed in the flat tube) ranged from 1 to 1.7 mm, and the hydraulic diameter of each by-pass passageway was chosen in the range of twice 1.7 mm to half 1.0 mm (corresponding to about 0.5 to 3.4 mm). The results of this test are reproduced in FIG. 9.

Figure 9:
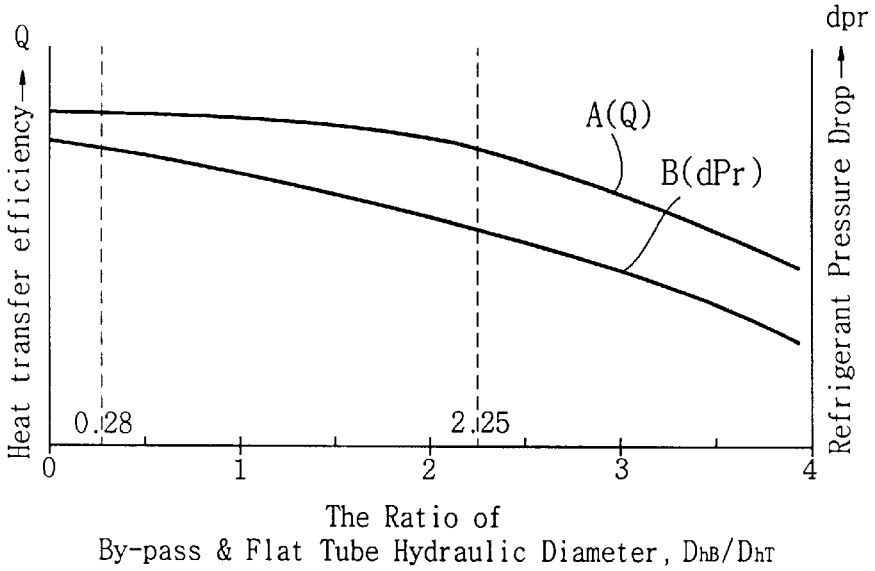
FIG. 9 is a graph showing a relationship between a heat transfer efficiency and a pressure drop according to variations of the size of a by-pass passageway versus a hydraulic diameter of a tube.

Referring now to FIG. 9, as can be seen, the desired performance of the condenser is not obtained if the ratio of the hydraulic diameter of the by-pass passageway to the hydraulic diameter of the tube, $D_{hB}/D_{hT}$, is beyond or below a certain prescribed limits. With the condenser having the by-pass passageways, it is seen that the heat transfer efficiency diminishes, on one hand, the press drop is improved, on the other hand.

From the results of tests, it was discovered that when the ratio of the hydraulic diameter of the by-pass passageway to the hydraulic diameter of the tube, $D_{hB}/D_{hT}$, is excessively small (below 0.28 as can be seen in FIG. 9), machining of the by-pass passageways are not only difficult to perform, but the expected the beneficial effects of by-pass of the liquid refeigerant are not achieved. If $D_{hB}/D_{hT}$ is excessively large (beyond 2.25 in FIG. 9), it appears that they by-passes of by-passing not only the liquid phase refrigerant but also the gaseous phase refrigerant. In addition, though the hydraulic diameter of the by-pass passageway over the hydralulic diameter of the tube is preferably defined as a reverse proportional relationship therebetween, when the hydraulic diameter of the tube is small (below about 1 mm) or large (beyond about 1.7 mm), the hydraulic diameter must be chosen in view of the effective areas of the passes with respect to the tubes having the middle range of hydraulic diameter ranging from 1 mm to 1.7 mm.

Analogous results were found with various shapes of the by-pass passageways wherein tests were executed on condensers having the by-pass passageways (i) provided by cut-out portions 25 from the baffles 19 as shown in FIGS. 2 and 3, (ii) formed in the inside surfaces of the header pipes 13 and 14 as shown in FIG. 4, and (iii) formed by lancing as shown in FIGS. 5 and 6. This demonstrates that the position and shape of the by-pass passageway does not affect the condenser performance. Moreover, considering that the liquid refrigerant gradually increases approaching to the lowermost pass, the number and size of the by-pass passageways providing the communication path for the liquid refrigerant between the upper and middle chambers 13*a* and 13*b* of the first header pipe 13 must be preferably larger than those between the middle and lower chambers 13*b* and 13*c* of the first header pipe 13. However, it was ascertained from the tests that there was not large difference in performance between the condenser provided with a progressively increased size of by-pass passageways approaching to the lowermost pass and the condenser with the same size of the by-pass passageways. In FIG. 9, curves A and B show that by-passing the condensed liquid refrigerant is focused on improvement of the pressure drop rather than the heat transfer efficiency, and thus, the pressure drop of the condenser with the by-pass passageways improves to some extent but the heat transfer efficiency thereof depreciates. FIG. 9 further shows that the heat transfer efficiency can be improved with respect to the condenser having the by-pass passageways by optimizing the ratio of the hydraulic diameter of the by-pass passageway to the hydraulic diameter of the tube.

Accordingly, in testing the condenser in which the effective area of each pass was also considered in addition to the relation between the tubes and the by-pass passageways and in which the effecitve area per pass was changed considering the degree of phase change and the flow rate of refrigerant in each pass, the heat transfer and pressure drop relationship was found to be substantially improved as compared to the conventional designs as described hereinafter.

Figure 10:
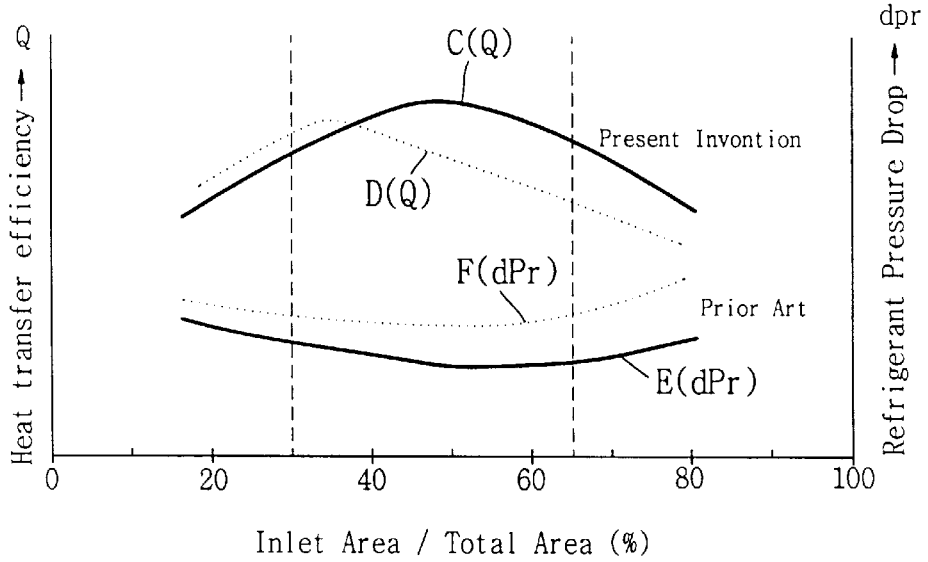
FIG. 10 is a graph showing a relationship between a heat transfer efficiency and a pressure drop according to variations of the ratio of the number of tubes constituting a pass on an inlet side with respect to the overall tubes.
Figure 11:
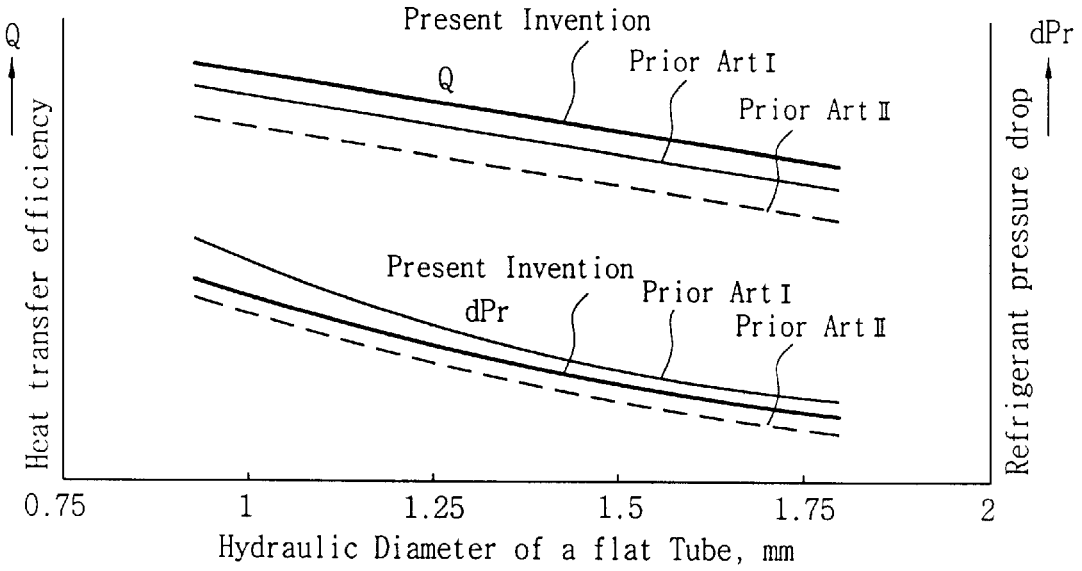
FIG. 11 is a graph showing a relationship between a heat transfer efficiency and a pressure drop with respect to variations of the hydraulic diameter of a tube.
Figure 12:
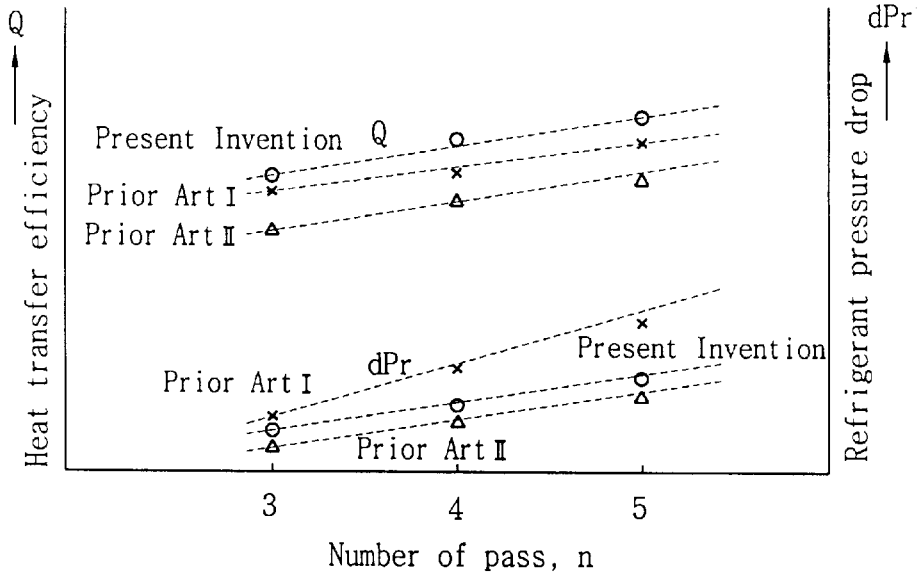
FIG. 12 is a graph showing a relationship between a heat transfer efficiency with respect to variations of the number of passes.
Figure 13:
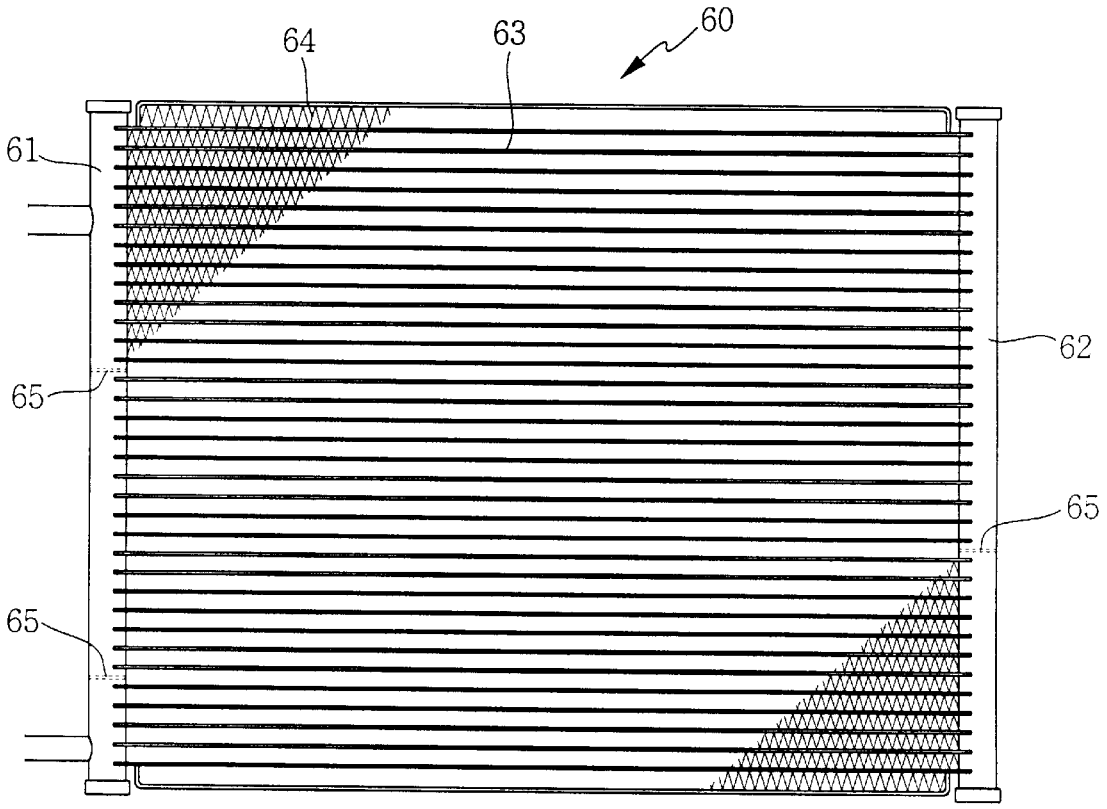
Fig. 13 PRIOR ART
FIG. 13 is a front view of a conventional condenser.
Figure 14:
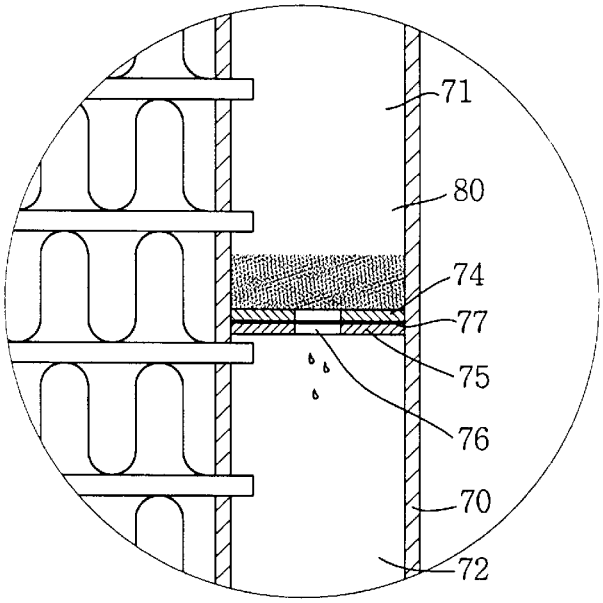
Fig. 14 PRIOR ART
FIG. 14 is an enlarged sectional view of elements around a baffle means of another conventional condenser.
Figure 15A:
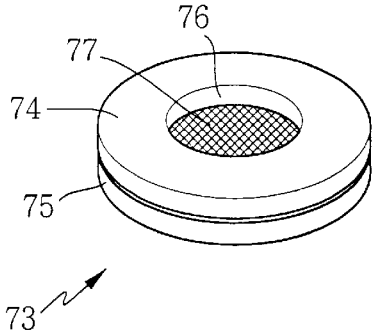
Fig. 15a PRIOR ART
FIGS. 15*a* and 15*b* are a perspective view and an exploded view, respectively, of the baffle means of FIG. 14.
Figure 15B:
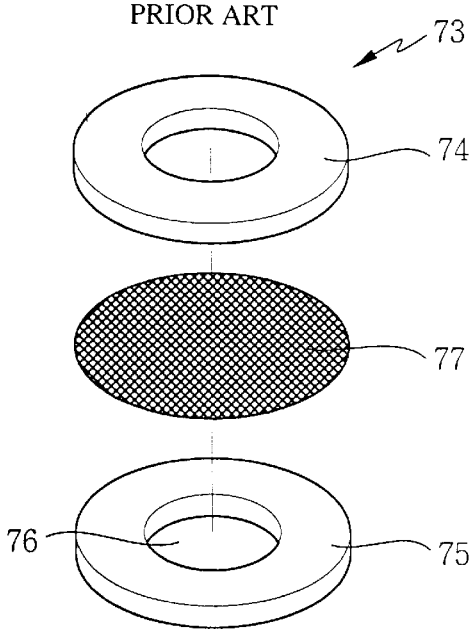
Fig. 15b PRIOR ART

Turning to FIGS. 10–12, there are shown the test results with the condenser of the invention and the conventional condenser as changing the hydraulic diameters of the tube and by-pass passageway, and the number of passes.

FIG. 10 shows trends between the heat transfer efficiency and pressure drop relation in combination with the effective areas of passes. In this case, the condenser had four passes and the ratio $D_{hB}/D_{hT}$ was 0.95.

Referring now to FIG. 10, it is seen from curves C and E versus D and F for the condenser of the present invention and a conventional condenser, respectively, that when the number of tubes constituting a pass on the refrigerant inlet side (the first uppermost pass) over the number of overall tubes constituting all passes of the condenser is less than 30%, with both the present and conventional condensers the heat transfer efficiency diminishes while the pressure drop increases. However, when the ratio of the number of tubes of the pass on the inlet side over the number of overall tubes ranges from 40% to 55%, the condenser of the present invention illustrates improvements of performance in both the heat transfer efficiency and pressure drop compared to a conventional condenser which also has the by-pass passageways. Moreover, in testing the condensers with three and five passes, respectively, it was found for a three pass condenser, it operates in optimum performance when the ratio of the number of tubes, which means heat transfer area, of the pass on the inlet side over the number of overall tubes, which means the entire heat transfer area of the condenser, ranges from 55% to 65%. If was found for a five pass condenser operates in optimum performance when the ratio ranges from 30% to 45%. Therefore, it is confirmed that the degree of phase change in the pass on the inlet side significantly affects the heat transfer performance, and the desired heat transfer performance occurs when the relationship between the flow rate of liquid refrigerant to be by-passed and the passes through which the vapor to be condensed flows without by-pass is selected in optimum. Namely, because the vapor introduced into the condenser through the inlet pipe has a relatively large volume and thus, the volume of the vapor is condensed through the pass on the inlet side, when not by-passing the condensed liquid both the pressure drop and flow resistance occur due to the flow rate difference between the vapor and the liquid. However, when by-passing the liquid refrigerant of relatively large volume, the vapor flows smoothly through the tubes and through even the passes near the lowermost pass without large difference in flow rate as compared with the flow rate in the pass on the inlet side.

By designing the condender with the above conditions, the number of passes can be increased to a certain extent even with the small hydraulic diameter because both the pressure drop and heat transfer efficiency improve, on one hand, while when utilizing large hydraulic diameter tube, the number of passes can also be increased, which means an increase in of the length of fluid paths, without the disadvantageous pressure drop, on the other hand. From these facts, it is deduced that with the same sized condensers, superior performace is obtained in the condenser according to the present invention over the conventional designs irrespective of presence of the by-pass passageways, and in turn, more compact condensers are provided according to the invention when design is made to obtain the same performance.

Turning to FIG. 11, there is shown the relationship between heat transfer efficiency and pressure drop with variations of the hydraulic diameter of the tube in the range of 1 to 1.7 mm. Prior art I is a conventional condenser without the by-pass passageways while prior art II is the condenser with the by-pass passageways formed in prior art I.

In FIG. 11, the number of passes and the ratio of the effective area of the passes on the inlet side over the number of overall tubes were four and about 30%–40%, respectively, for both prior arts I and II. As can be seen, the pressure drop of prior art II with the by-pass passageways is less than that of prior art I without the by-pass passageways, while the heat transfer efficiency of prior art II depreciates relative to that of prior art I, and accordingly, the performance of the condenser with the by-pass passageways is inferior to that of the condenser without the by-pass passageways. However, with the condenser according to the present invention to which the ratio of the hydraulic diameter of the by-pass passageway over the hydraulic diameter of the flat tube, 0.28–2.25, and the ratio of the area of the pass on the inlet side over the area of overall passes, 30–60%, are applied, when the hydraulic diameter of the tube increases, the heat transfer efficiency of the present invention is superior to those of prior arts I and II while the pressure drop of the present invention is superior to prior art I, on one hand, inferior to prior art II, on the other hand. The reason the pressure drop of the present invention is a little higher than that of prior art II is construed as more vapor together with the liquid is by-passed in the condenser of prior art II than in the condenser of the present invention because the area of the pass on the inlet side of prior art II is smaller than that of the present invention. Namely, FIG. 11 shows that the amounts of the vapor condensed through the pass on the inlet side and the ratio of the hydraulic diameter of the by-pass passaeway over the hydraulic diameter of the tube are related with each other irrespective of the hydraulic diameters used in the normal tubes, and the condenser performance is best when the area of the pass on the inlet side is chosen in the range shown in FIG. 10. Accordingly, the desired heat transfer efficiency and pressure drop is acquired when optimizing the raito of the hydraulic diameter of the by-pass passageway over the hydraulic diameter of the tube and selecting the number of tubes constituting the pass on the inlet side in a given prescribed range in consideration of the number of passes formed in the condenser.

Referring now to FIG. 12, there are shown the results of tests with variations of the number of passes under the conditions as described in relation to FIG. 11 in which prior art I is a common condenser without the by-pass passageways and prior art II is a condenser with the by-pass passageways but a smaller area of the pass on the inlet side than that of the present invention. FIG. 12 shows that too many passes accompanies restrictions because the increase of the number of passes enhances the heat transfer efficiency but raises the pressure drop. Namely, the heat transfer efficiency increases with rapid rising of the pressure drop in prior art I, while in prior art II, the pressure drop is slow with the inferior heat transfer efficiency to prior art I, and thus, the same trends are identified as in FIG. 11. On the other hand, with the condenser of the present invention, the heat transfer efficiency increases but the pressure drop increases slowly, and accordingly, an increase in the number of passes to a given extent under the same conditions accompanies fewer restrictions.

In consideration of the data as shown in FIGS. 9–12, the performance of the condenser in aspects of the heat transfer efficiency and pressure drop is improved by designing condensers in view of three conditions: first, the hydraulic diameter of each tube used in the multiflow type condenser; second, the hydraulic diameter of the by-pass passageways over the hydraulic diameter of the tube; and finally, the ratio of the number of the tubes constituting the pass on the inlet side, i.e. the area of the pass (P1 in FIG. 1) on the inlet side to the number of overall tubes constituting the overall passes of the condenser.

Namely, when the hydraulic diameter of each tube ranges from 1 to 1.7 mm, the ratio of the hydraulic diameter of the by-pass passageway over the hydraulic diameter of the tube, $D_{hB}/D_{hT}$ is between 0.28 and 2.25, and the ratio of the area of the pass on the inlet side over the area of the overall pases ranges from 30% to 65%, the performance of parallel flow type condenser is improved as compared to condensers not fulfilling the above three conditions, irrespective of presence of the by-pass passageways in such condensers. For example, optimized performance was observed with the condenser having four passes, and each tube of the ratio of $D_{hB}/D_{hT}$ ranging from 0.45 to 1.85, with the ratio of the area of the pass on the inlet side over the area of the overall passes ranging 40% to 55%.

The present invention has been described in an illustrative manner. Many modifications and variations of the present invention are possible in light of the above teachings. Therefore, the spirit and scope of the invention are to be limited only by the terms of the appended claims.

What is claimed is:

1. A multiflow type condenser for an automobile air conditioner comprising:

a pair of header pipes disposed in parallel with each other and arranged to have an inlet and an outlet, said header pipes being elliptical in cross-section;

a plurality of flat tubes each connected to said header pipes at opposite ends thereof, each of said flat tubes having a plurality of inside fluid paths, a hydraulic diameter of said inside fluid paths being in the range of about 1 to 1.7 mm;

a plurality of corrugated fins each disposed between adjacent flat tubes;

at least a pair of baffles disposed in said header pipes;

at least one by-pass passageway formed around a position at which the chambers in each header pipe are divided by the baffle therein to route a vapor-abundant phase of said refrigerant from an upper chamber to a lower chamber within the same header pipes by providing a communication path between the adjacent chambers;

a ratio of a hydraulic diameter of said by-pass passageway over said hydraulic diameter of said inside fluid paths being in the range of about 0.28 to 2.25; and an area of a pass on the inlet side defined by the chamber on the inlet side into which said refrigerant is introduced through said inlet and formed in one of said header pipes, the opposed chamber formed in the other of said header pipes, and a plurality of tubes extending between the chambers is about 30% to 65% of an overall area of all of said passes.

2. The condenser of claim 1, wherein said passes are three and said area of said pass on the inlet side is about 55% to 65% of said overall area of said passes.

3. The condenser of claim 1, wherein said passes are four and said area of said pass on the inlet side is about 40% to 55% of said overall area of said passes.

4. The condenser of claim 1, wherein said passes are five and said area of said pass on the inlet side is about 30% to 40% of said overall area of said passes.

5. The condenser of claim 1, wherein said by-pass passageway is formed in central portions of said baffles, respectively, by lancing.

6. The condenser of claim 1, wherein said by-pass passageway is formed in outer peripheral portions of said baffles, respectively.

7. The condenser of claim 1, wherein said by-pass passageway is formed in said baffles, respectively, such that the number of by-pass passageways progressively increases from said inlet to said outlet.

8. The condenser of claim 1, wherein said by-pass passageway is formed in said baffles, respectively, such that said ratio of said hydraulic diameter of said by-pass passageway over said hydraulic diameter of said inside fluid paths progressively increases within said ratio from said inlet to said outlet.

9. The condenser of claim 1, wherein said by-pass passageway is formed more than at least one in an inside surface of each of said header pipes.

10. The condenser of claim 9, wherein said by-pass passageways are formed such that said ratio of said hydraulic diameter of said by-pass passageway over said hydraulic diameter of said inside fluid paths progressively increases within said ratio from said inlet to said outlet.

11. The condenser of claim 1, wherein said projection extends outside each header pipes and is pressed around an outer surface of each of said header pipes by caulking means.

12. The condenser of claim 1, wherein each of said baffles has a projection inserted into a slit provided with each header pipe and dividing each header pipe into a plurality of chambers so that a refrigerant flows through a plurality of passes each defined by a plurality of tubes in zigzag fashion between said inlet and said outlet, an outer peripheral surface of each baffle coming into contact with an inner peripheral surface of said respective header pipes.

* * * * *